US005145402A

United States Patent [19]

Plyler et al.

[11] Patent Number: 5,145,402

[45] Date of Patent: Sep. 8, 1992

[54] ELECTRICAL CONNECTOR

[75] Inventors: Robert G. Plyler, Vienna; Joseph M. Senk, Cortland, both of Ohio

[73] Assignee: General Motors Corporation, Detroit, Mich.

[21] Appl. No.: 794,323

[22] Filed: Nov. 12, 1991

Related U.S. Application Data

[63] Continuation of Ser. No. 534,586, Jun. 6, 1990, abandoned.

[51] Int. Cl.[5] ..... H01R 13/58

[52] U.S. Cl. ..... 439/459; 439/936; 439/274

[58] Field of Search ..... 439/719, 271, 274, 275, 439/279, 445, 456, 459, 587, 457, 936, 606

[56] References Cited

U.S. PATENT DOCUMENTS

| | | | |
|---|---|---|---|
| 2,228,237 | 1/1941 | Sofield et al. | 439/606 |
| 2,280,855 | 4/1942 | Rose | 439/275 |
| 3,555,171 | 1/1971 | Larson | 174/138 |
| 3,775,615 | 8/1973 | Paullus et al. | 174/76 |
| 3,897,129 | 7/1975 | Farrar, Jr. | 339/116 |
| 4,173,349 | 11/1979 | Neale, III | 439/279 |
| 4,311,421 | 1/1982 | Plyler et al. | 439/274 |
| 4,335,932 | 6/1982 | Herrmann, Jr. | 439/936 |
| 4,492,421 | 1/1985 | Ito | 439/271 |
| 4,634,207 | 1/1987 | Debbaut | 339/116 |
| 4,662,692 | 5/1987 | Uken et al. | 339/96 |
| 4,802,864 | 2/1989 | Michaels et al. | 439/457 |
| 4,875,870 | 10/1989 | Hardy et al. | 439/936 |
| 4,921,437 | 5/1990 | Cooper et al. | 439/275 |

FOREIGN PATENT DOCUMENTS

| | | |
|---|---|---|
| 1148613 | 11/1959 | Fed. Rep. of Germany . |
| 2930658 | 7/1979 | Fed. Rep. of Germany . |
| 3417811 | 5/1984 | Fed. Rep. of Germany . |
| 3623927 | 7/1986 | Fed. Rep. of Germany . |
| 1295369 | 5/1962 | France . |
| 900598 | 7/1962 | United Kingdom . |

*Primary Examiner*—Larry I. Schwartz
*Assistant Examiner*—Hien D. Vu Hdv
*Attorney, Agent, or Firm*—Francis J. Fodale

[57] ABSTRACT

An electrical connector comprising a multiple terminal connector body has a sturdy and easily installed end cap that is secured to the connector body for sealing the cable end. The end cap includes a seal chamber that is disposed in a common cavity at the cable end of the connector body and contains a compliant sealing material which seals the open ends of the terminal cavities and encapsulates projecting ends of the electric terminals and trailing portions of the electric cables. The end cap is configured to maintain the integrity of the seal chamber, to permit the electric cables to pass out of the common cavity at the cable end of the connector body, to assure that the electric terminals are properly located in the terminal cavities of the connector body and to provide a strain relief in cooperation with portions of the connector body.

18 Claims, 2 Drawing Sheets

ELECTRICAL CONNECTOR

This is a continuation of application Ser. No. 07/534586 filed on Jun. 6, 1990 now abandoned.

BACKGROUND OF THE INVENTION

This invention relates generally to electrical connectors for electrical cable that are sealed by compliant sealing material at the cable end.

Such connectors are already known from U.S. Pat. No. 3,555,171 granted to Robert L. Larson on Jan. 12, 1971; U.S. Pat. No. 3,775,615 granted to Clarence Leonard Paullus and Larry Ronald Stauffer Aug. 28, 1973; U.S. Pat. No. 3,897,129 granted to John A. Farrar, Jr. Jul. 29, 1975; U.S. Pat. No. 4,634,207 granted to Christian A. Debbaut Jan. 6, 1987; U.S. Pat. No. 4,662,692 granted to William D. Uken and Robert S. Dubrow May 5, 1987; and U.S. Pat. No. 4,875,870 granted to Judy Hardy and Kenneth Wallington Oct. 24, 1989. While these connectors are useful in particular circumstances, each has one or more drawbacks so that it is not completely satisfactory, particularly, in the case of sealing the cable end of multiple terminal electrical connectors.

SUMMARY OF THE INVENTION

The object of this invention is to provide an improved electrical connector for electric cable that includes improved means for sealing the cable end of the electrical connector particularly, when multiple electric terminals and cables are involved.

A feature of the invention is that the improved electrical connector has means for sealing the cable end of a multiple terminal electrical connector which is sturdy and easy to install.

Another feature of the invention is that the improved electrical connector has an improved sealing means for sealing the cable end of the electrical connector that also provide a strain relief and assure that the electric terminals are properly seated in the electrical connector.

Another feature of the invention is that the improved electrical connector has an end cap that seals the cable end of the electrical connector as well as assures that the electric terminals are properly seated in the electrical connector.

Another feature of the invention is that the improved electrical connector has an end cap that seals the cable end of the electrical connector as well as provides a strain relief.

Another feature of the invention is that the improved electrical connector has a simple snap-on end cap that has a chamber containing compliant sealing material that seals the cable end of the electrical connector.

Another feature of the invention is that the end cap has means for securing the end cap to the electrical connector that do not perforate or interrupt the walls of the chamber containing compliant sealing material for sealing the cable end of the electrical connector.

Still another feature of the invention is that the end cap cooperates with the connector body of the electrical connector to bend the electric cables so as to provide an excellent strain relief.

Still yet another feature of the invention is that the end cap does not require perforations, interruptions, slits or the like for electric cables to exit from the chamber containing compliant sealing material for sealing the cable end of the electrical connector.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
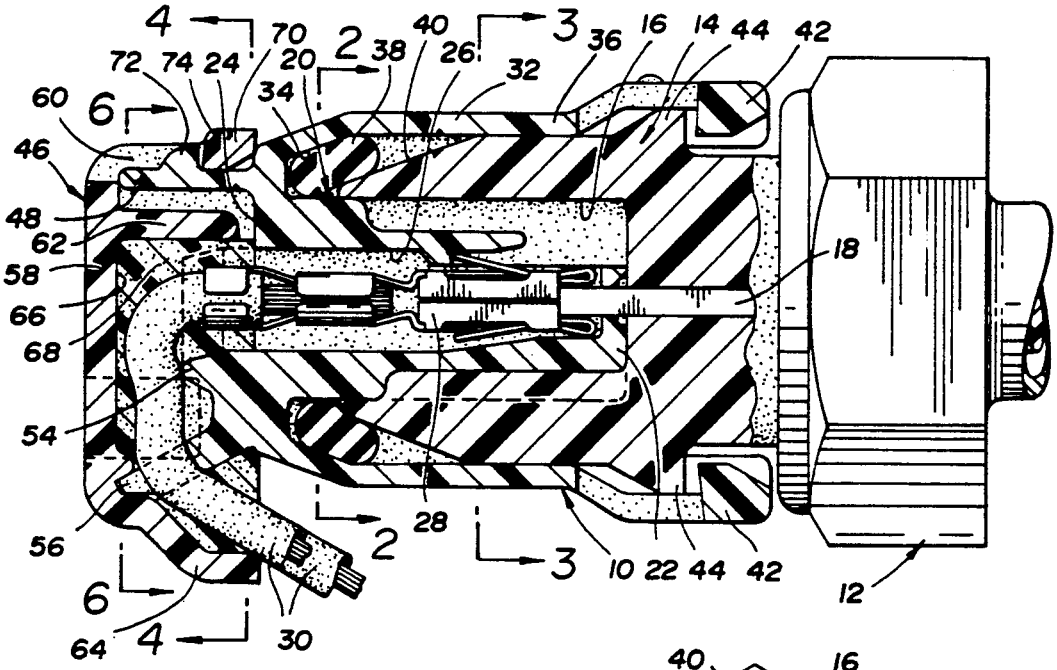
FIG. 1 is longitudinal section of an electrical connector in accordance with this invention.
Figure 2:
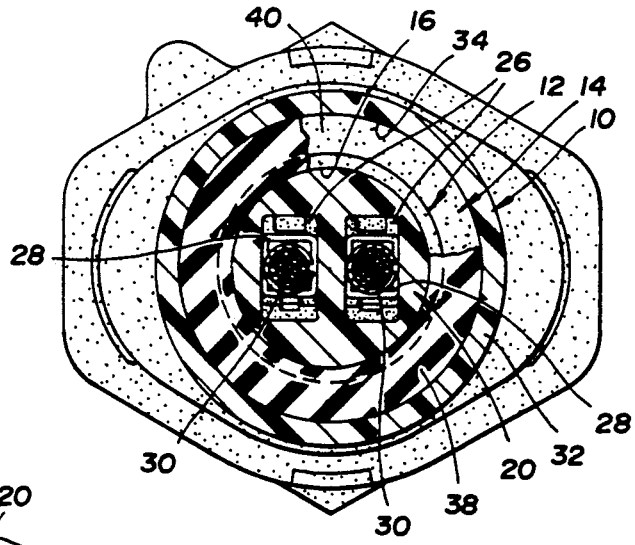
FIG. 2 is a section taken substantially along the line 2—2 of FIG. 1 looking in the direction of the arrows.
Figure 3:
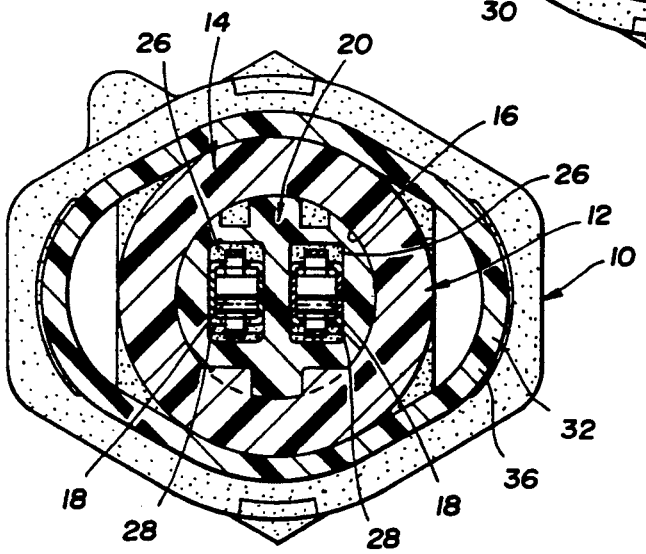
FIG. 3 is a section taken substantially along the line 3—3 of FIG. 1 looking in the direction of the arrows.

Referring now to the drawing, particularly FIG. 1, an electrical connector 10 in accordance with this invention is shown connected to an electrical device 12, such as a temperature sensor, that includes a mating electrical connector 14 comprising a socket 16 and blade or pin terminals 18 that project into the socket 16.

The electrical connector 10 comprises a connector body 20 having a contact end 22, a cable end 24 and a plurality of terminal cavities 26 which extend through the connector body from the contact end to the cable end. A plurality of electric terminals 28 attached to electric cables 30 are disposed in the respective terminal cavities 26 so that trailing portions of the electric cables 30 extend out of the terminal cavities 26 at the cable end of the connector body 20. The electric terminals 28 are properly positioned and retained in the terminal cavities 26 by a front wall at the contact end 22 of the connector body 20 and latch shoulders in the terminal cavities 26 that are engaged by latch tangs of the terminals 28 as best shown in FIG. 1.

The connector body 20 further includes a shroud 32 that fits over the connector 14 when the connector body 20 is plugged into the socket 16. The shroud 32 has an inner conical portion 34 of circular cross section and an outer oval shaped portion 36. The inner conical portion 34 supports an elastomeric 0-ring 38 that has a circular section when installed. The tip of the connector 14 has an outer conical surface 40 that is at the same angle as the inner surface of the inner conical portion 34. The elastomeric O-ring 38 is elastically distorted by this inner surface to seal against the outer conical surface 40 at the tip of the connector 14 when the connector body 20 is plugged into the socket 16 as best shown in FIG. 1.

The matching angle of the inner surface of conical portion 34 and conical surface 40 is preferably less than 45° so that the compression of the elastomeric O-ring 38 is less than the longitudinal travel of the connectors 10 and 12 during engagement. This compensates for connector lock over-travel and O-ring material stiffness while allowing the sealing surfaces of the connectors to be molded in a conventional manner.

The outer oval shaped portion 36 includes inwardly directed latches 42 at its minor diameter which engage lock nibs 44 of the electrical connector 14 to lock the electrical connector 10 to the electrical device 12. The electrical connector 10 is released and pulled out of the socket 16 in a well known manner by squeezing the oval shaped portion of the shroud 32 at its major diameter.

The electrical connector 10 includes an end cap 46 that is secured to the connector body 20 for sealing the cable end 24 of the connector body, assuring that the electric terminals 28 are properly positioned and retained in the terminal cavities 26, and providing a strain relief as will now be explained in detail in connection with FIGS. 1, 4, 5, 6, 7 and 8.

Figure 6:
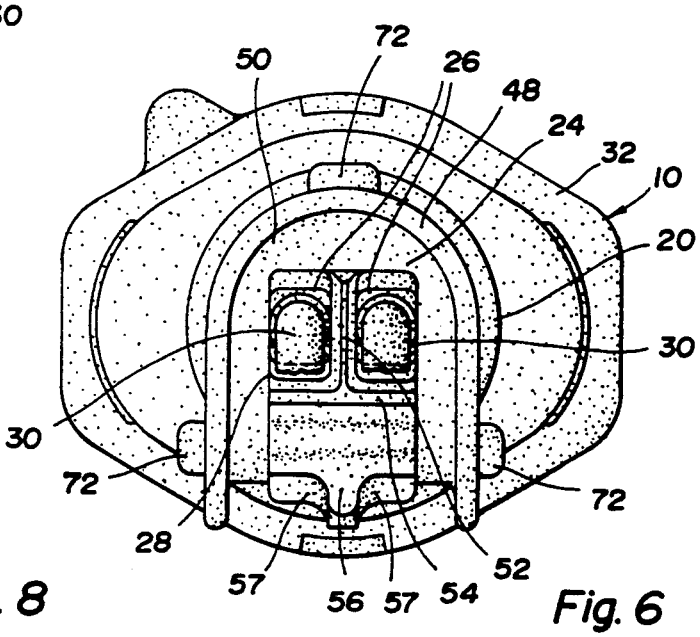
FIG. 6 is an end view of the electrical connector (with an end cap removed) taken substantially along the line 6—6 of FIG. 1 looking in the direction of the arrows.

The connector body 20 has a longitudinal hood 48 at the cable end 24 that forms a common cavity 50. The common cavity 50 communicates with the terminal cavities 26 and receives protruding portions of the electric terminals 28 and trailing portions of the electric cables 30 that extend out of the terminal cavities 26. The longitudinal hood 48 is U-shaped in cross section so that the bottom of the common cavity 50 is open as best shown in FIG. 6.

The connector body 20 has a partition wall 52 between each set of adjacent terminal cavities 26 that extends part way into the common cavity 50 for isolating the protruding portions of the electrical terminals 28 from each other. The connector body 20 also has an anvil 54 beneath the terminal cavities 26 which extends part way into the common cavity 50 crosswise of the terminal cavities 26. This anvil bends the trailing portions of the electric cables 30 substantially perpendicular to the terminal cavities 26 when the end cap 46 is secured to the connector body 20 as best shown in FIG. 1. The connector body 20 further includes a separator 56 that is disposed below the anvil 54 for spacing the perpendicularly bent trailing portions of the electric cables 30 from each other. The separator 56 projects rearwardly and downwardly from the cable end 24 of the connector body 20 and into the open space at the bottom of the U-shaped hood 48.

The anvil 54 and the separator 56 create a channel 57 below the anvil 54 which permits each of the trailing portions of the electric cable 30 to be completely encapsulated as explained below.

Figure 4:
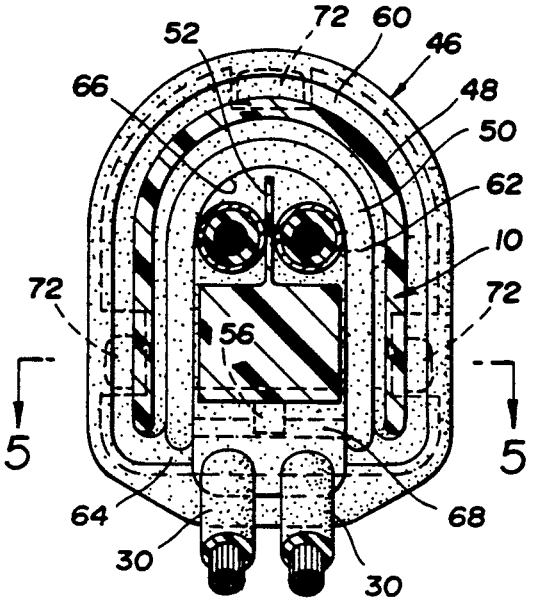
FIG. 4 is a section taken substantially along the line 4—4 of FIG. 1 looking in the direction of the arrows.
Figure 5:
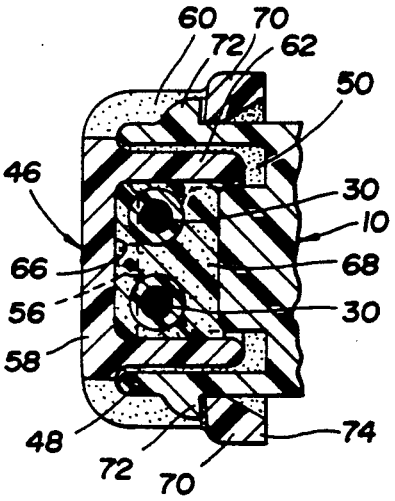
FIG. 5 is a section taken substantially along the line 5—5 of FIG. 4 looking in the direction of the arrows.

The end cap 46 comprises an end wall 58, an outer hood 60 that is integrally attached to an outer edge of the end wall 58 and an inner hood 62 that is integrally attached to the end wall 58 inwardly of the outer hood 60. The inner hood 62 is spaced from the outer hood 60 so that the longitudinal hood 48 of the connector body 20 fits between the inner and outer hoods 62 and 60 as best shown in FIGS. 1, 4 and 5. Thus when attached, the end cap 46 has an outer hood 60 that is disposed outside the longitudinal hood 48 of the connector body 20 and an inner hood 62 that is disposed inside the longitudinal hood 48.

The end cap 46 further includes a lip 64 that is integrally attached to a lower edge of the end wall 58 and to the lower ends of the inner and outer hoods 62 and 60. The lip 64, the inner hood 62 and the end wall 58 cooperatively form a seal chamber 66 containing a compliant sealing material 68 that seals the cable end of the electrical connector 10 when the end cap 46 is secured to the connector body 20 as best shown in FIGS. 1 and 5.

A preferred compliant sealing material 68 is silicone dielectric gel such as Sylgard 527 marketed by Dow Corning Corporation. This material is a two component, transparent silicone encapsulant specially designed to seal, protect and preserve electrical characteristics. The two parts of the silicone dielectric gel may be mixed in various ratios depending upon the firmness and cure rates desired.

The end cap 46 containing the compliant sealing material is secured to the hood 48 of the connector body 20 by snap-on retaining means comprising lock shoulders 70 of the end cap 46 and cooperating outwardly projecting lock nibs 72 of the longitudinal hood 48. The end cap 46 is secured to the longitudinal hood 48 simply by pressing the end cap 46 on the end of the hood 48 with thumb pressure which causes the lock nibs 72 to snap past and engage behind the lock shoulders 70. It should be noted that the lock shoulders 70 are formed as part of the outer hood 60 by molding slots in the outer hood 60 that extend from the end wall 58 up to an enlarged rim 74 of the outer hood 60. This configuration is easily molded but more importantly, location of the lock shoulders 70 on the outer hood 70 preserves the integrity of the seal chamber 66. In other words the end cap 46 is secured to the electrical connector 10 by lock shoulders which do not perforate, interrupt or otherwise compromise the walls of the seal chamber 66 so that the flow of compliant sealing material 68 for sealing the cable end of the electrical connector 10 is controlled and contained when the end cap 46 is attached so as to avoid unnecessary loss of seal material and/or a messy, sticky end cap. Moreover, the close proximity between the inner hood 62 of the end cap 46 and the longitudinal hood 48 of the connector body 20 forces the compliant sealing material 68 to completely fill the ends of the terminal cavities 26 and around the individual trailing ends of the cables 30 particularly in the area of the channel 57.

When the end cap 46 is secured to the connector body 20, the lip 64 is disposed below the separator 56 and spaced from the connector body 20 to permit the perpendicularly bent trailing ends of the electric cables 30 to pass out of the common cavity 50 at the cable end of the connector body 20 and the seal chamber 66. Moreover, the separator 56 and the lip 64 are configured so that they cooperate to bend the perpendicularly bent trailing portions back toward the contact end 22 of the connector body 20 as best shown in FIG. 1. This reversely bent configuration of the trailing portions of the electrical cables 30 provides an excellent strain relief.

Figure 7:
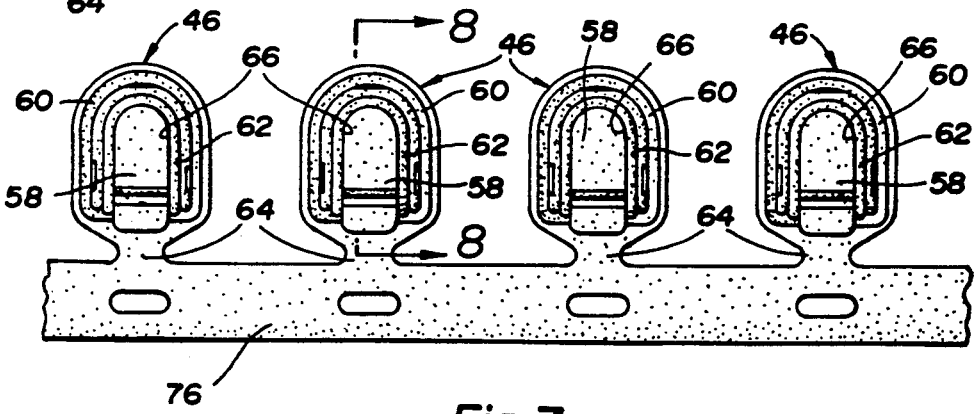
FIG. 7 is a plan view showing a stage of manufacture of end caps for the electrical connector that is shown in FIGS. 1–6.

Referring now to FIG. 7, the end caps 46 are preferably made of a stiff plastic material, such as Hytrel, which is a block copolymer of a glycol (soft segment) and a polyester PTB marketed by E. I. DuPont de Nenmours and Company. The end caps 46 are preferably molded in strip form in which a series of end caps 46 are integrally attached to a carrier strip 76 for ease of handling during the manufacturing process. The strip is then delivered to a fill station where the seal chambers 66 are filled with compliant sealing material 68. When a sealing material such as the silicone dielectric gel Sylgard 527 is used, the two parts are mixed and poured into the seal chambers 66 in liquid form and cured in the end caps 46. The end caps 46 are then severed from the carrier strip 76 and attached to the connector body 20.

Figure 8:
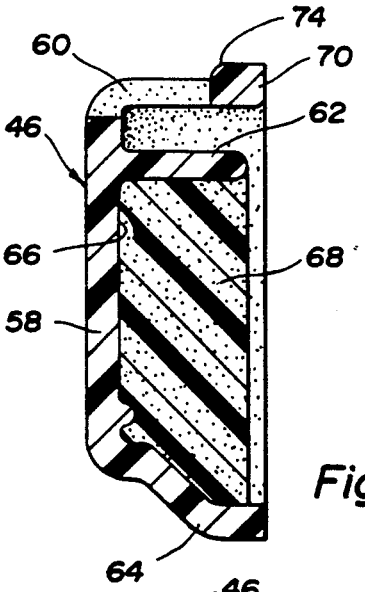
FIG. 8 is a vertical section of a typical end cap taken along the line 8—8 of FIG. 7 looking in the direction of the arrows.

An end cap 46 having its seal chamber 66 filled with the cured sealing material 68 is shown in FIG. 8. Such an end cap 46 is then simply pushed onto the end of the longitudinal hood 48 at the cable end of the connector body 20. When the end cap 46 is secured in place, the sealing material 68 closes the open ends of the terminal cavities 26 and encapsulates the end portions of the electric terminals 28 and the trailing portions of the electric cables 30 as best shown in FIGS. 1 and 5. It should be noted that the channel 57 between the anvil 54 and separator 56 insures that each trailing portion of the electric cables 39 is completely surrounded and encapsulated by the sealing material 68.

On the one hand, the amount of sealing material 66 that is initially poured and cured in the end cap 46 is sufficient to completely seal the ends of the terminal cavities 26 and encapsulate the terminal ends and trailing portions of the electric cables 30 within the end cap 46. On the other hand the amount of sealant is preferably such that little or no sealing material escapes out of the end cap 46 between the lip 64 and the connector body 20.

It should also be noted that the end cap 46 for sealing the cable end of the electrical connector 10 cannot be secured to the electrical connector unless the electric terminals 28 are properly seated in the terminal cavities 26 due to the necessary proximity of the end wall 58 which cooperates with the anvil 54 to bend the trailing portions of the cables 30 perpendicularly.

Thus the snap-on end cap 46 not only seals the cable end of the electrical connector 10 but it also assures that the electric terminals 28 are properly seated in the electrical connector as well.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector comprising:

a connector body having a cable end and a plurality of terminal cavities which open into a common cavity at the cable end of the connector body, a plurality of electric terminals attached to electric cables that are disposed in the respective terminal cavities with trailing portions of the electric cables disposed in the common cavity, and an end cap which is secured to the connector body for sealing the cable end of the connector body, the end cap having a hood and a lip cooperatively forming a seal chamber with an end wall of the end cap, the seal chamber communicating with the common cavity of the connector body and containing a compliant sealing material which seals the cable end of the electrical connector when the end cap is secured to the connector body, and the lip of the end cap being spaced from the connector body to permit the trailing portions of the electric cables to pass out of the common cavity between the lip and the cable end of the connector body.

2. The electrical connector as defined in claim 1 wherein the end wall of the end cap is in close proximity to the cable end of the connector body so that the end cap cannot be secured to the connector body unless electric terminals are properly positioned in the terminal cavities.

3. The electrical connector as defined in claim 1 wherein the compliant sealing material is a gel sealant.

4. An electrical connector comprising:

a connector body having a cable end and a plurality of terminal cavities which open into a common cavity at the cable end of the connector body, a plurality of electric terminals attached to electric cables that are disposed in the respective terminal cavities with trailing portions of the electric cables disposed in the common cavity, and an end cap which is secured to the connector body for sealing the cable end of the connector body, the end cap having a hood and a lip cooperatively forming a seal chamber with an end wall of the end cap, the seal chamber communicating with the common cavity of the connector body and containing a compliant sealing material which seals the cable end of the electrical connector when the end cap is secured to the connector body, and the connector body having a separator that extends into the common chamber for spacing the trailing portions of the electric cables from each other, and the lip is disposed below the separator and spaced from the connector body to permit the electric cables to pass out of the common cavity between the lip and the cable end of the connector body.

5. An electrical connector comprising:

a connector body having a cable end and a plurality of terminal cavities which open into a common cavity at the cable end of the connector body, a plurality of electric terminals attached to electric cables that are disposed in the respective terminal cavities with trailing portions of the electric cables disposed in the common cavity, and an end cap which is secured to the connector body for sealing the cable end of the connector body, the end cap having a hood and a lip cooperatively forming a seal chamber with an end wall of the end cap, and the seal chamber communicating with the common cavity of the connector body and containing a compliant sealing material which seals the cable end of the electrical connector when the end cap is secured to the connector body, and the connector body having an anvil which extends part way into the common cavity crosswise of the terminal cavities that bends the trailing portions of the electric cables substantially perpendicular to the terminal cavities when the end cap is secured to the connector body.

6. The electrical connector as defined in claim 5 wherein the lip of the end cap is spaced from the connector body to permit the trailing portions of the electric cables to pass out of the common cavity between the lip and the cable end of the connector body and cooperates with portions of the connector body to reversely bend the trailing portions of the electric cable.

7. An electrical connector comprising:

a connector body having a cable end and a plurality of terminal cavities which open into a common cavity at the cable end of the connector body, a plurality of electric terminals attached to electric cables that are disposed in the respective terminal cavities with trailing portions of the electric cables disposed in the common cavity, an end cap which is secured to the connector body for sealing the cable end of the connector body, the end cap having a hood and a lip cooperatively forming a seal chamber with an end wall of the end cap, the seal chamber communicating with the common cavity of the connector body and containing a compliant sealing material which seals the cable end of the electrical connector when the end cap is secured to the connector body, and the end cap having means spaced outwardly of the hood for securing the end cap to the connector body.

8. The electrical connector as defined in claim 7 wherein the end cap has an outer hood which is spaced outwardly of the hood forming part of the seal chamber and the means spaced outwardly of the hood for securing the end cap to the connector body is located on the outer hood to preserve the integrity of the seal chamber.

9. The electrical connector as defined in claim 1 wherein the compliant sealing material is a silicone dielectric gel that is cured in the seal chamber of the end cap before it is secured to the connector body.

10. The electrical connector as defined in claim 9 wherein the end cap has an outer hood which is spaced outwardly of the hood forming part of the seal chamber and the means spaced outwardly of the hood for securing the end cap to the connector body is located on the outer hood to preserve the integrity of the seal chamber.

11. An electrical connector comprising:

a connector body having a cable end, a longitudinal hood that extends from the cable end to form a common cavity, and a plurality of terminal cavities that open into the common cavity at the cable end of the connector body, a plurality of electric terminals attached to electric cables that are disposed in the respective terminal cavities with trailing portions of the electric cables disposed in the common cavity at the cable end of the connector body, and an end cap which is secured to the connector body for sealing the cable end of the connector body, the connector body having an anvil which extends part way into the common cavity crosswise of the terminal cavities for bending the trailing portions of the electric cables substantially perpendicular to the terminal cavities when the end cap is secured to the connector body, the connector body having a separator disposed below the anvil for spacing the bent trailing portions of the electric cables from each other, the end cap having an outer hood which is disposed outside the longitudinal hood of the connector body and secured to the longitudinal hood of the connector body by snap-on retaining means, the end cap having an inner hood disposed inside the longitudinal hood of the connector body, the end cap having a lip disposed below the separator and spaced from the connector body to permit the bent trailing portions of the electric cables to pass out of the common cavity at the cable end of the connector body, the inner hood and the lip cooperatively forming a seal chamber with an end wall of the end cap, and the seal chamber communicating with the common cavity at the cable end of the connector body and containing a compliant sealing material which seals the cable end of the electrical connector when the end cap is secured to the connector body.

12. The electrical connector as defined in claim 11 wherein the compliant sealing material is a gel sealant.

13. The electrical connector as defined in claim 11 wherein the compliant sealing material is a silicone dielectric gel that is cured in the seal chamber of the end cap before it is secured to the connector body.

14. The electrical connector as defined in claim 11 wherein the separator of the connector body and the lip of the end cap cooperate to bend the trailing portions of the electric cables back toward the terminal cavities.

15. The electrical connector as defined in claim 11 wherein the end wall of the end cap is in close proximity to the cable end of the connector body so that the end cap cannot be secured to the connector body unless electric terminals are properly positioned in the terminal cavities.

16. The electrical connector as defined in claim 7 wherein the compliant sealing material is a gel sealant.

17. The electrical connector as defined in claim 7 wherein the compliant sealing material is a silicone dielectric gel that is cured in the seal chamber of the end cap before it is secured to the connector body.

18. The electrical connector as defined in claim 3 wherein the end cap has an outer hood which is spaced outwardly of the hood forming part of the seal chamber and the means spaced outwardly of the hood for securing the end cap to the connector body is located on the outer hood to preserve the integrity of the seal chamber.

* * * * *